US005833398A

United States Patent [19]

LeNormand

[11] Patent Number: 5,833,398

[45] Date of Patent: Nov. 10, 1998

[54] DYNAMIC SELF-COMPENSATING VOLUME DEFORMATION SUPPORT SYSTEM

[76] Inventor: Edward J. LeNormand, 489 Grove St., Norwell, Mass. 02061

[21] Appl. No.: 734,723

[22] Filed: Oct. 18, 1996

[51] Int. Cl.[6] ..... E02D 27/32

[52] U.S. Cl. ..... 405/229; 52/167; 248/550; 405/303

[58] Field of Search ..... 405/229, 303, 405/289, 290; 248/550; 52/167

[56] References Cited

U.S. PATENT DOCUMENTS

| | | | |
|---|---|---|---|
| 2,582,363 | 1/1952 | Thiry | 248/550 X |
| 3,281,101 | 10/1966 | May | 248/550 |
| 4,154,552 | 5/1979 | Van Bilderbeek | 405/229 |
| 4,191,496 | 3/1980 | Becker | 405/229 |
| 4,771,581 | 9/1988 | Nill | 405/229 X |
| 5,156,494 | 10/1992 | Owens et al. | 405/229 |
| 5,471,802 | 12/1995 | Yano et al. | 248/550 X |

*Primary Examiner*—Dennis L. Taylor
*Attorney, Agent, or Firm*—Iandiorio & Teska

[57] ABSTRACT

A dynamic, self compensating constant volume deformation support system includes a sealed constant volume containment chamber including a base and a rigid peripheral wall; a load-carrying deformable plate carried by and attached to the peripheral wall; a non-compressible fluid within the containment chamber supporting the plate and responding to a negative deflection created by an applied load to the plate by creating an opposite and offsetting pressure uniformly distributed on the underside of the plate for creating a positive deflection of the plate and producing a net deflection an order of magnitude lower than normally induced by the applied load.

22 Claims, 6 Drawing Sheets

DYNAMIC SELF-COMPENSATING VOLUME DEFORMATION SUPPORT SYSTEM

FIELD OF INVENTION

This invention relates to a system for supporting a plate or slab and more particularly to a constant volume deformation support system for supporting a plate or slab over a medium normally unsuitable for such support by conventional support methods.

RELATED APPLICATIONS

This application is related to provisional patent application Ser. No. 60/005,775 filed Oct. 20, 1995, for "Constant Volume Deformation System".

BACKGROUND OF INVENTION

Historically there have been three basic methods available for the construction of a concrete slab on grade whose footprint is underlain by soils such as peat, poor quality fill, or soft clay, normally considered unsuitable for slab support. One method is to install support elements such as caissons, piles, or the like through this material to a suitable bearing and then construct a framed reinforced concrete slab which is capable of carrying required design loads to span between these supports. This method essentially by-passes the unsuitable material and can be very expensive depending on the depth necessary to obtain a suitable bearing as well as the number of piles necessary to support a slab of a given size. A second method is to remove the unsuitable material by excavation where feasible and replace it with suitable material and properly compact it. This method may also be expensive and not cost-effective due to the amount of material that must be removed as well the material that must replace the unsuitable soil.

The third option, depending on the use of the slab, is simply to place it over the unsuitable material and live with any distortions, cracking or the like which occur as a result of settlement of the poor soil. This is an inefficient method as the slab will eventually need to be replaced.

SUMMARY OF INVENTION

It is therefore an object of this invention to provide a constant volume deformation support system.

It is a further object of this invention to provide such a constant volume deformation support system which when a load is applied produces a net deflection much smaller than would occur with conventional support systems.

It is a further object of this invention to provide such a constant volume deformation support system which virtually eliminates plate deflection due to the plate's self-weight.

It is a further object of this invention to provide such a constant volume deformation support system which allows the use of a thinner slab or plate than would otherwise be required by conventional support methods.

It is a further object of this invention to provide such a constant volume deformation support system which requires the use of fewer support pilings.

It is a further object of this invention to provide such a constant volume deformation support system which does not require the removal and replacement of an unsuitable support media.

It is a further object of this invention to provide a constant volume deformation support system which can be monitored and adjusted after completion and even during use of the slab or plate.

The invention results from the realization that a truly effective slab support can be achieved using a self-compensating constant volume deformation support system in which a constant volume containment chamber is filled with a non-compressible fluid so that when a load is applied at one location or region of one side of the supported slab or plate causing it to negatively deflect a corresponding opposite offsetting pressure is generated within the chamber and is uniformly distributed on the other side of the slab or plate to create a positive deflection so that resulting net deflection is an order of magnitude lower than that normally induced by an applied load.

The invention features a dynamic self-compensating constant volume deformation support system which includes a sealed constant volume containment chamber including a base and a rigid peripheral wall. There is a load carrying deformable plate or slab carried by and attached to the rigid peripheral wall. There is a non-compressible fluid filling the containment chamber for supporting the plate or slab and, in response to an applied load to one side of the plate or slab creating a negative deflection thereof, generating an opposing offsetting pressure within the containment chamber which is uniformly distributed on the other side of the plate or slab creating a positive deflection of the plate and producing a net deflection an order of magnitude lower than would normally be induced by the applied load.

In a preferred embodiment the constant volume deformation support system may have a base and a peripheral wall which are integral and made of concrete. There may be a base made of soil which is otherwise unsuitable for supporting a slab. There may be included in the containment chamber a leakproof liner for preventing leakage of the non-compressible fluid. The leakproof liner may be made of PVC or HDPE. The non-compressible fluid may be water. The non-compressible fluid may further include a biocide for preventing bacteria growth within the fluid. The non-compressible fluid may also contain antifreeze to prevent the fluid from freezing when used in cold environments. The non-compressible fluid may also include a gelling agent to prevent leakage of the non-compressible fluid. The constant volume deformation support system may include a sensor system for monitoring a fluid level. There may be a device for adding non-compressible fluid to the containment chamber when the fluid level falls below a predetermined level. The constant volume deformation support system may further include a fluid supply system which responds to the fluid level sensing system for adding fluid to the sealed containment chamber. The constant volume deformation support system may further include a slab or plate which is fixedly attached to the rigid peripheral wall. The slab may be fixedly attached with rebar within the slab and peripheral wall. The slab may be fixedly attached to the rigid peripheral wall with grout. The slab may be fixedly attached to the rigid peripheral wall using bolts. The rigid peripheral wall may include a steel medium fixedly disposed along its top edge. The plate may be a steel plate. The steel plate may be fixedly attached to the peripheral wall by welding the plate to the steel medium.

DISCLOSURE OF PREFERRED EMBODIMENT

Other objects, features and advantages will occur to those skilled in the art from the following description of a preferred embodiment and the accompanying drawings, in which.

Figure 1A:
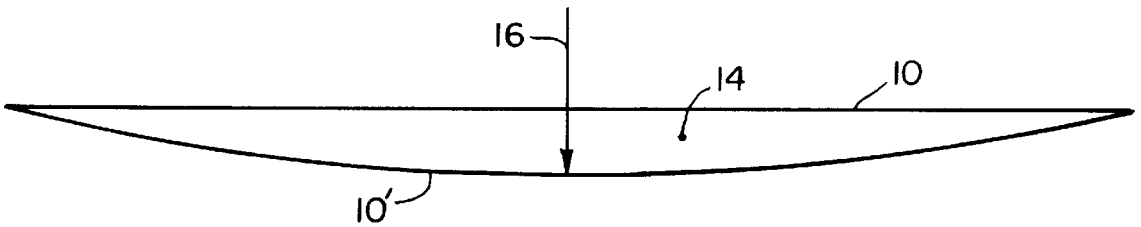
FIG. 1A is a representation of a negative deflection which occurs in a beam subjected to an applied load.

In order to better understand the constant volume deformation support system of the present invention, consider first constant volume deformation as it applies to a linear one dimensional structure such as a beam. Referring to FIG. 1A there is shown a beam 10 of length L under no load supported on the walls of a fluid filled containment chamber (shown in FIGS. 2A and 2B). As a concentrated load is applied mid-span along the beam 10 indicated by arrow 16 the beam 10 undergoes a negative deflection induced by the concentrated load 16 resulting in a negatively deflected beam 10'. Disregarding for the moment the corresponding offsetting pressure generated within the fluid, the deflection induced in the beam 10' can be determined by the following equation:

$$\Delta_{CONC} = \frac{Px}{48EI}\ (3L^2 - 4x^2) \text{ for } x \leqq L/2 \text{ only} \tag{1}$$

Where:

P=magnitude of concentrated applied load.

L=total span length.

x=distance along the span measured from the end of the beam to the point on the beam at which it is desired to calculate the deflection.

E=modulus of elasticity.

I=moment of inertia.

Integrating this equation results in the volume displaced due to the negative deflection and is determined by the following equation:

$$V_{conc.load} = \frac{2P}{48EI}\ (1.5L^2x^2 - x^4) \tag{2}$$

This volume 14 is represented by the area between beam 10 and beam 10'. In order to give the analysis more meaning we can assume a unit width of 1 inch so that we may work with volume instead of area. If the containment chamber is filled with a non-compressible fluid and if the containment chamber prevents the escape of the non-compressible fluid the total volume of the liquid must remain constant. The containment chamber must have relatively thick walls whose flexural stiffness is many times greater than that of the beam itself and the non-compressible fluid must completely fill the containment chamber below the beam. The depth of the non-compressible fluid is of no significance provided that it is sufficient to prevent the beam 10' from "bottoming out" on the floor of the containment chamber.

Figure 1B:
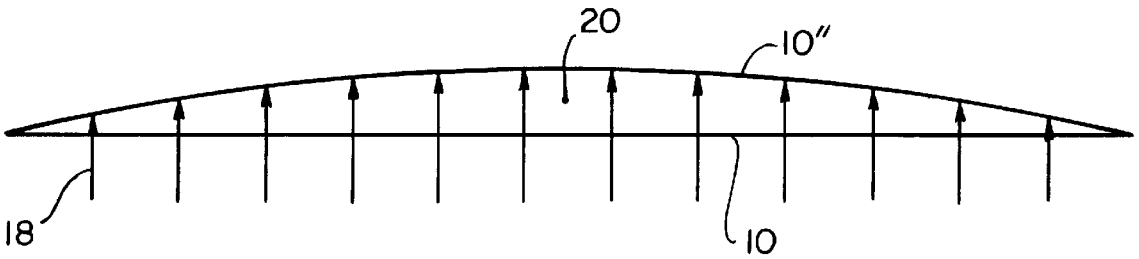
FIG. 1B is a representation of a corresponding opposite offsetting pressure resulting from the applied load of FIG. 1A which causes a positive deflection.

Since the containment chamber is filled with a non-compressible fluid, and the base and wall of the chamber are inflexible so that they do not deflect, any negative deflection of the beam 10' caused by an applied downward load 16 must result in a corresponding upward deflection uniformly distributed at points away from the applied load caused by the increase in pressure of the fluid in the containment chamber. Referring to FIG. 1B an upward uniform force 18 due to the pressure generated within the fluid is applied over the entire length of the beam 10 causing an upward "bulge" in the unloaded area resulting in a positively deflected beam 10". The positive deflection due to the corresponding uniformly distributed offsetting pressure generated by the non-compressible fluid can be determined by the formula:

$$\Delta_{unif} = \frac{wx}{24EI}\ (L^3 - 2Lx^2 + x^3) \text{ for } x \leqq L \tag{3}$$

Where w=uniform pressure x,E,I,L are as stated above.

Given that the base and wall of the containment chamber are inflexible so as to undergo no deflection, the volume displaced by a negative deflection must equal the volume displaced by a positive deflection. Integrating Equation (3) above over the length of the beam must yield a volume exactly equal to the volume 14 above and is represented by:

$$V_{unif.load} = \frac{w}{480.EI}\ (10.L^3x^2 - 10.Lx^4 + 4.x^5) \tag{4}$$

The upward deflection displaces a volume 20 which is the area between an undeflected beam 10 and a positively deflected beam 10", and is exactly equal to volume 14.

Figure 1C:
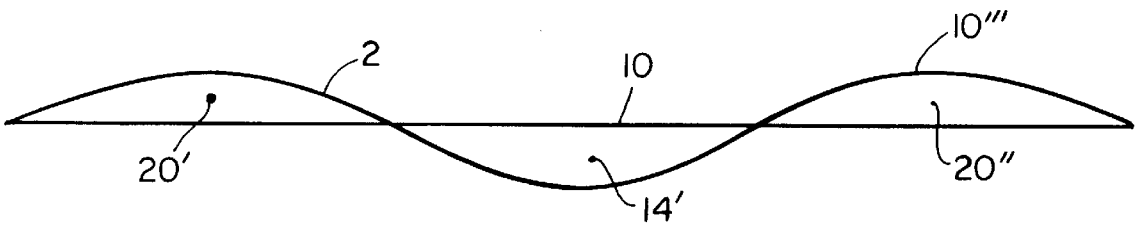
FIG. 1C is a representation of the net deflection which occurs in the beam due to an applied load according to the present invention.

Referring to FIG. 1C, a negatively displaced volume 14' must equal the sum of the uniformly displaced volume 20' plus 20". The beam 10"' therefore undergoes a net deflection much smaller than if there were no liquid in the containment chamber. Setting equation (4) equal to equation (2) it is possible to determine the magnitude of the internal fluid pressure, w, generated by the applied load 16.

The advantages of the constant volume deformation can be better understood by using actual numerical values. Given P=10.0 kips, L=20 feet and I=118 for a W10X22 steel beam we can determine the deflection of a beam having no liquid beneath it. For the applied load, P:

$$M_{max} = \frac{PL}{4} = \frac{(10)(20)}{4} = 50.0 \text{ ft.-kips} \tag{5}$$

$$\text{Reaction}_{conc} = \frac{P}{2} = \frac{10}{2} = 5.0 \text{ kips} \tag{6}$$

-continued $$\Delta_{Max.conc.} = \frac{PL^3}{48EI} = \frac{(10.)\,(20.)^3(1{,}728)}{(48.)(29{,}000.)(118)} = .824 \text{ inch} \tag{7}$$

Using equation (2) above the volume within the deflected shape due to a concentrated load of 10.0 kips is 126.2 in.$^3$. By filling the containment chamber with a non-compressible liquid, remembering that there must initially be sufficient liquid to prevent the beam from deflecting under its own weight, the volume within the deflected shape for uniform load of 1.0 kips per foot is 161.6 cubic inches. Setting equations (2) and (4) equal, the internal pressure, w, is determined to be 0.781 kips per square foot.

The uniform load due to internal pressure is:

$$M_{Max.Unif.} = \frac{wL^2}{8} = \frac{(.781)\,(20.)^2}{8} = 39.05 \text{ ft.-kips} \tag{8}$$

$$\text{Reaction}_{unif.} = \frac{wL}{2} = \frac{(.781)(20)}{2} = 7.81 \text{ kips} \tag{9}$$

$$\Delta_{Max.unif.} = \frac{5.wL^4}{384.EI} = \frac{(5)(.781)\,(20.)^4(1{,}728.)}{(384.)(29{,}000.)(118)} = .822 \text{ inch} \tag{10}$$

Combining the results of the two loading conditions yields:

$$M_{Max.C.V.D.}=50.-39.05=10.95 \text{ ft.-}kips \tag{11}$$

$$\text{Reaction}_{C.V.D.}=5.0-7.81=-2.81\ kips(UPLIFT) \tag{12}$$

$$\Delta_{Max.C.V.D.}=0.842-0.822=0.02 \text{ inch} \tag{13}$$

Therefore, under the constraint of constant volume deformation the beam which would have experienced a maximum moment of $50^{I-k}$ now experiences a maximum moment of $10.95^{I-k}$ and the maximum deflection which would have been 0.842 inch has been reduced to 0.02 inch.

While the application of constant volume deformation to a one dimensional beam is convenient for illustrative purposes, in order to have a real world practical benefit it must be analyzed as it applies to a flat plate. A slab or plate is supported on a containment chamber which includes a rigid peripheral wall which is virtually inflexible and a base which is also virtually inflexible. The containment chamber is completely filled with a non-compressible fluid. In order to provide support for a downward load and prevent a net uplift, the plate or slab must be attached to the upper edge of the peripheral wall. The non-compressible liquid must be in an amount sufficient to create a pressure exactly equal to the weight of the slab or plate. Therefore, the slab's own self weight, as a uniform load, is totally supported by a corresponding uniform upward pressure generated within the liquid. The slab thus undergoes no deflection and experiences no stress from its own self weight. Disregarding for the moment the corresponding offsetting pressure generated within the liquid, for a concentrated downward load applied to a slab or plate of radius R, the deflection at any point on the slab or plate can be determined by the formula:

$$\Delta_{conc.r<R_o} = -\frac{3W(m^2-1)}{16\pi Em^2t^3}\left[4R^2-5R_o^2+\frac{r^4}{R_o^2}-(8r^2+4R_o^2)\log\frac{R}{R_o}-\frac{2(m-1)R_o^2(R^2-r^2)}{(m+1)R^2}+\frac{8m(R^2-r^2)}{m+1}\right] \tag{14}$$

-continued $$\Delta_{conc.r>R_o} = -\frac{3W(m^2-1)}{16\pi Em^2t^3}\left[\frac{(12m+4)(R^2-r^2)}{m+1}-\frac{2(m-1)R_o^2\,(R^2-r^2)}{(m+1)R^2}-(8r^2+4R_o^2)\log\frac{R}{r}\right] \tag{15}$$

Where

R=overall radius of slab.

$R_0$=radius of loaded circular area.

r=radial distance to any given point.

W=total applied load.

m=reciprocal of Poisson's ratio.

t=slab thickness.

E=modulus of elasticity.

log=logarithm to the base "e".

Multiplying equations (14) and (15) by 2πr and integrating over the applicable range of values of "r" for each allows the volume displaced by the deflected shape to be determined, and is represented by:

$$V_0^{R0} = 2\pi R_0^2\frac{3W(m^2-1)}{16\pi Em^2t^3}\left[2R^2-\frac{7}{3}R_0^2-4R_0^2\log\frac{R}{R_0}+\left(\frac{8m}{m+1}-\frac{2(m-1)R_0^2}{(m+1)R^2}\right)\left(\frac{R^2}{2}-\frac{R_0^2}{4}\right)\right] \tag{16}$$

$$V_{R0}^{R} = 2\pi\frac{3W(m^2-1)}{16\pi Em^2t^3}\left[\left(\frac{12m+4}{m+1}-\frac{2(m-1)R_0^2}{(m+1)R^2}\right)\left(\frac{R^4}{4}-\frac{R^2R_0^2}{2}+\frac{R_0^4}{4}\right)-R_0^2R^2-\frac{1}{2}R^4-4R_0^4\log\frac{R_0}{R}+\frac{3}{2}R_0^4\right] \tag{17}$$

Consider a 5000 lb. concentrated load applied to a 4 inch slab. Using the constant: E=3,122,000 psi, m=5 (Poisson's ratio=0.2) and $R_O$=2 ft., the volume displaced is determined to be 1,465 ft$^3$. This results in a negative deflection of 5.48 inches as determined by equation (14) above, and a reaction of 15.9 lbs/ft. of circumference. Turning to the constant volume constraint, the applied load will generate a pressure within the liquid and will create an upward bulge in the slab at areas away from the applied load. As with the linear analysis, due to the constant volume constraint, the upward bulges must contain a volume equal to that at the depressed area near the applied load. The value of liquid pressure necessary to create a volume equal and opposite to that resulting from the applied load can be found using the same approach as applied to the linear beam system discussed above. The deflection at any point on the slab subjected to a uniform load can be found using the formula:

$$\Delta_{unif.} = -\frac{3W(m^2-1)}{8\pi Em^2t^3}\left[\frac{(5m+1)R^2}{2(m+1)}+\frac{r^4}{2R^2}-\frac{(3m+1)r^2}{m+1}\right] \tag{18}$$

Multiplying this formula by 2πr and integrating over the range of values of r under an applied uniform load of 1.0 psf yields a volume for this load represented by:

$$V = 2\pi R^4\frac{3W(m^2-1)}{8\pi Em^2t^3}\left[\frac{m}{2(m+1)}+\frac{1}{12}\right] \tag{19}$$

This can be compared to that found for the concentrated applied load. The volume for a unit uniform load is determined to be 1,062 ft$^3$. In order to have a net volume change of zero the uniform load due to liquid pressure must be 1,465/1,062=1.38 psf, not the unit 1.0 psf used above. In other words, a 5,000 lb. concentrated load generates a pressure within the encapsulated non-compressible fluid of 1.38 psf as the slab responds to the applied load. This results in a uniform upward deflection of 4.8 in., and a reaction$_{unif.}$= 34.5 lbs./ft. of circumference. The net deflection is therefore determined to be 5.48 in.−4.85 in.=0.63 in. This yields a net reaction of 15.9−34.5=−18.6 lbs./ft. of circumference (uplift).

The above analysis, or any other less simplified analysis, may be accomplished using finite element analysis. STAAD III by Research Engineers, Inc., located in Yorba Linda, Calif., provides one method of computer assisted analysis.

Figure 2A:
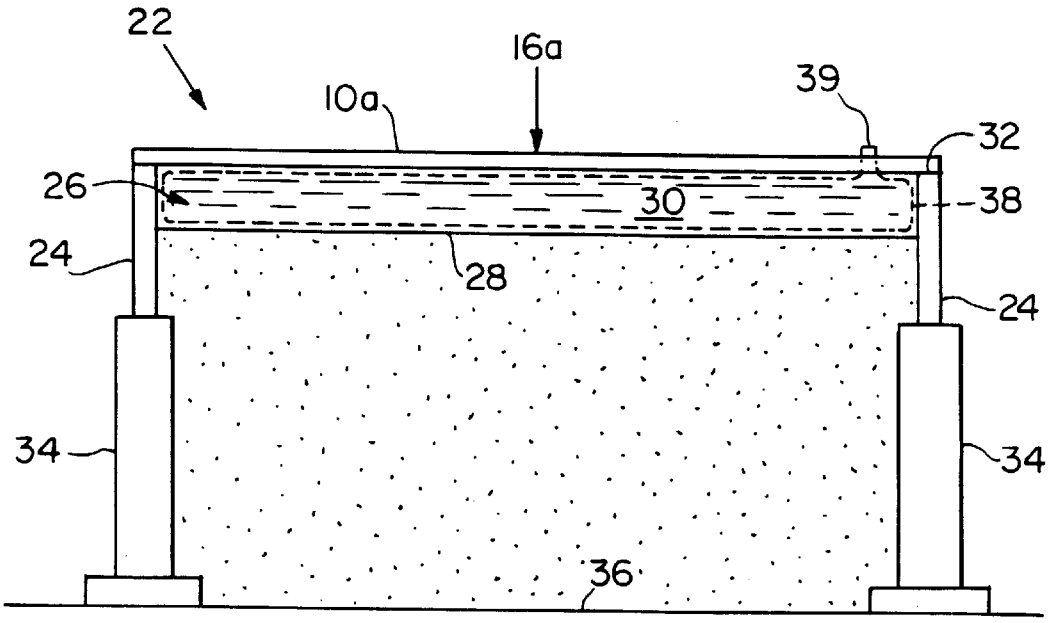
FIG. 2A is a schematic diagrammatic side sectional elevational view of one embodiment of the present invention.

Referring to FIG. 2A there is shown a preferred embodiment of the constant volume deformation support system 22 of the present invention. There is a sealed containment chamber 26 which includes a rigid inflexible peripheral wall 24 and a rigid inflexible base 28. The peripheral wall 24 may be made of concrete. The base 28 may be a soil normally unsuitable for slab support or a non-compressible soil overlying a compressible soil. The containment chamber 26 is filled with a non-compressible fluid 30. Non-compressible fluid 30 may be water, oil, hydraulic fluid or the like. In order to prevent freezing of the non-compressible fluid 30 in cold climates, an antifreeze may be added to the non-compressible fluid 30. In order to prevent bacterial growth in the non-compressible fluid 30 a biocide may be added. The containment chamber 26 may include a leakproof liner 38 which may be made of polyvinyl chloride (PVC), high density polyethylene (HPDE), or the like. The liner 38 may have a valve or nozzle 39 for introducing additional fluid to the chamber in the event of changes in liquid volume due to settlement, leakage, or the like. In order to prevent leakage of the non-compressible fluid 30 from containment chamber 26 a gelling agent such as CARBOPOL available from B F Goodrich may be added to the non-compressible fluid. A slab or plate 10*a* is attached to the upper edge 32 of peripheral wall 24. A slab or plate may be a concrete slab poured on site, a prefabricated concrete slab, a steel plate, or any material suitable to construct a slab on grade. The slab or plate 10*a* must be attached along edge 32 so as to prevent any separation of the slab or plate 10*a* from upper edge 32 of the peripheral wall 24. The peripheral wall 24 is vertically supported by pilings 34 or any conventional foundation system sunk to suitable bearing 36 sufficient to prevent vertical movement of the peripheral wall 24. Peripheral wall 24 is fixedly attached to piling 34 in order to prevent a total uplift of slab 10*a* under a loaded condition.

Figure 2B:
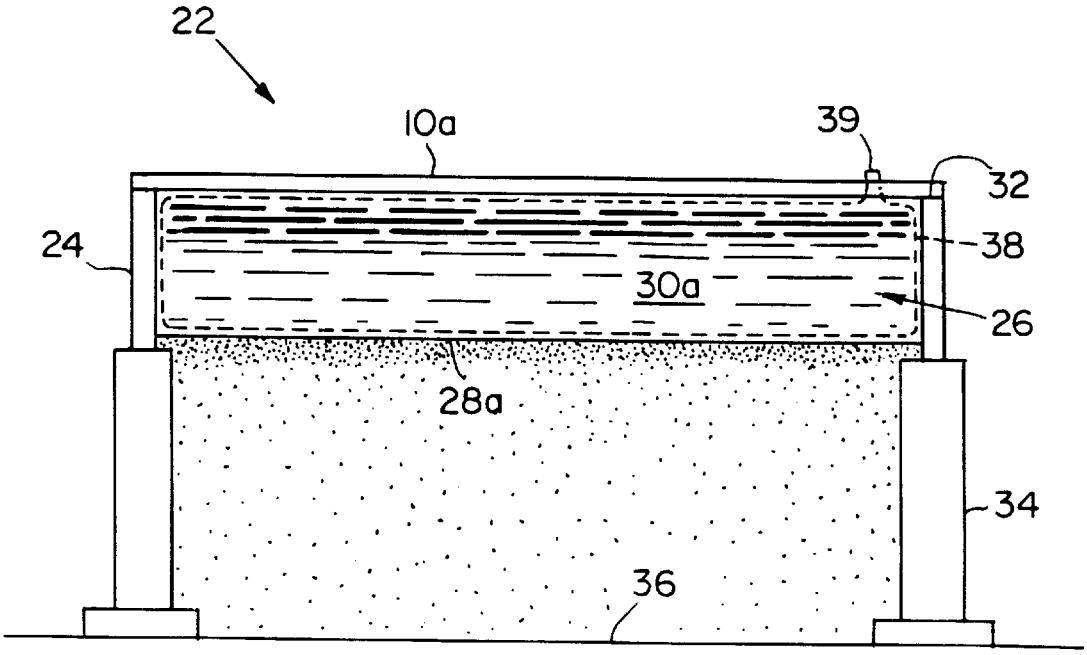
FIG. 2B is a schematic diagrammatic side sectional elevational view of one embodiment of the present invention after settlement of the base over a period of elapsed time.

Referring to FIG. 2B there is shown the constant volume support system 22 of FIG. 2A after a period of time where the base 28*a* has settled due to the unsuitability of the soil to support slab-on-grade construction. In order to compensate for this settling, additional non-compressible fluid 38*a* may be added to the containment chamber 26 in order to completely fill the containment chamber 26. It is critical that too much fluid is not added in order to prevent excessive uniform upward load on the slab.

Figure 3:
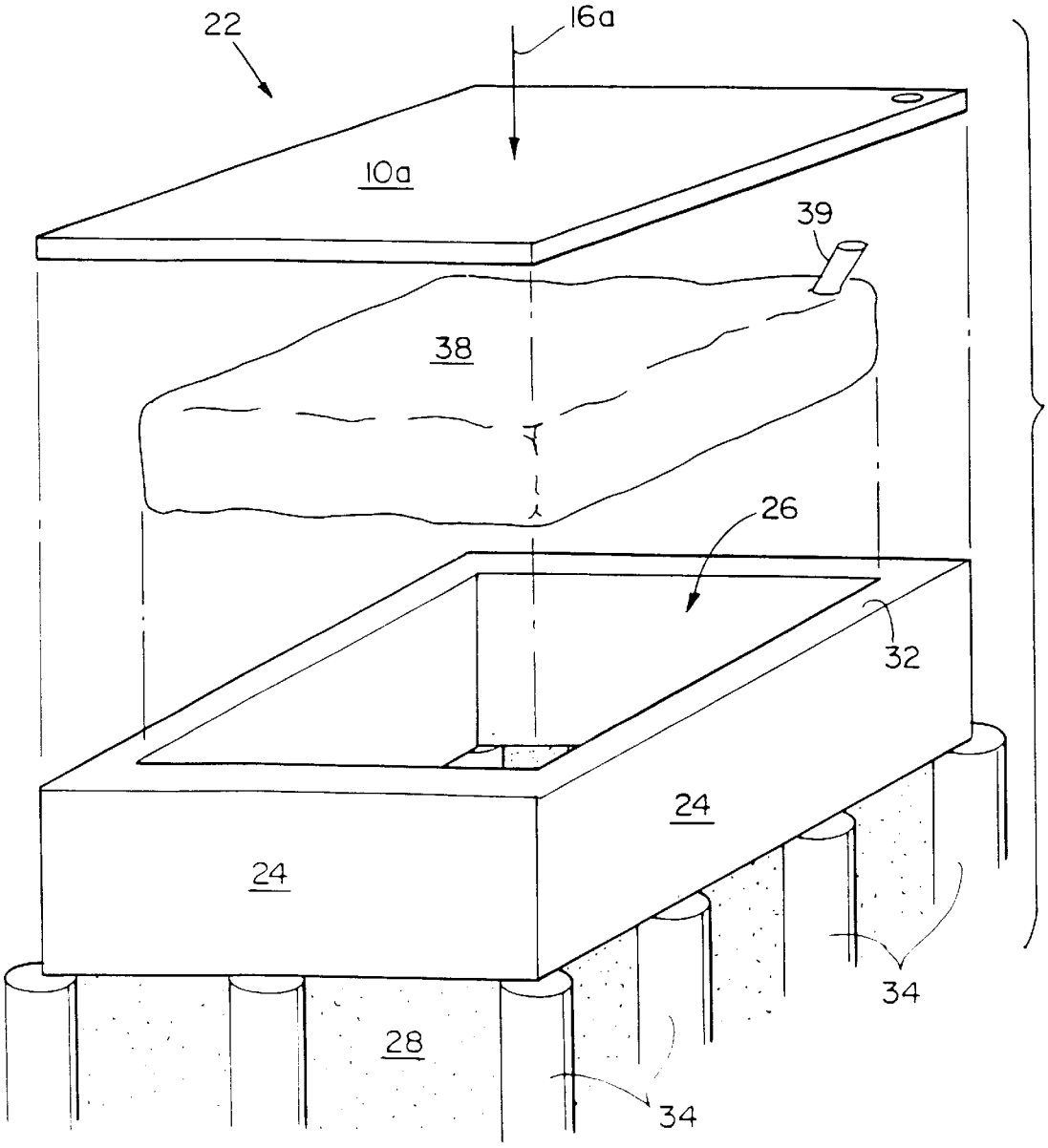
FIG. 3 is an exploded view of one embodiment of a constant volume deformation support system of the invention.

Referring to FIG. 3 there is shown a three-dimensional view of a preferred embodiment of the constant volume deformation support system 22 of the present invention. A containment chamber 26 includes a peripheral wall 24 and a soil base 28. The peripheral wall 24 is fixedly attached to pilings 34 sunk into base 28. A liner 38 is placed within containment chamber 26 to prevent leakage of non-compressible fluid 30. A valve 39 allows the addition of fluid. A slab or plate 10*a* is attached to the upper edge 32 of the peripheral wall 24 so as to prevent separation of the slab or plate 10*a* from the upper edge 32 of peripheral wall 24.

Figure 4C:
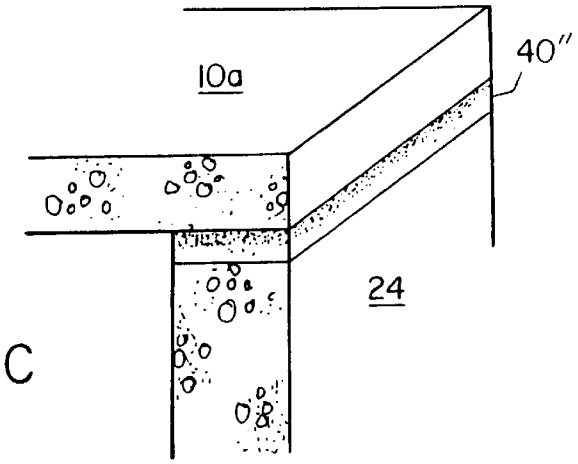
FIG. 4C is a three-dimensional view with parts broken away of an attachment device in an alternate embodiment of this invention.
Figure 4D:
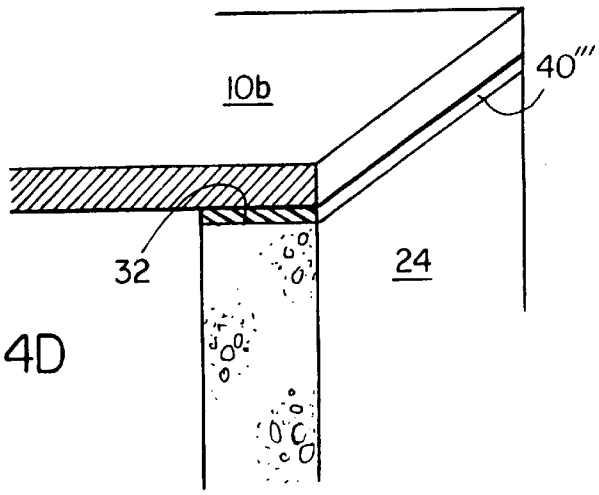
FIG. 4D is a three-dimensional view with parts broken away of an attachment device in an alternate embodiment of this invention.
Figure 4A:
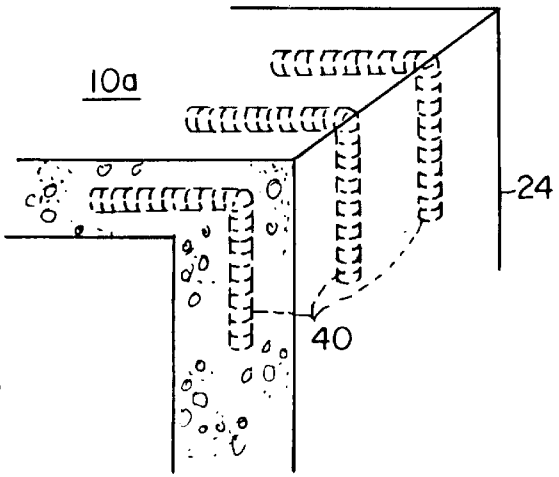
FIG. 4A is a three-dimensional view with parts broken away of an attachment device in a preferred embodiment of this invention.
Figure 4B:
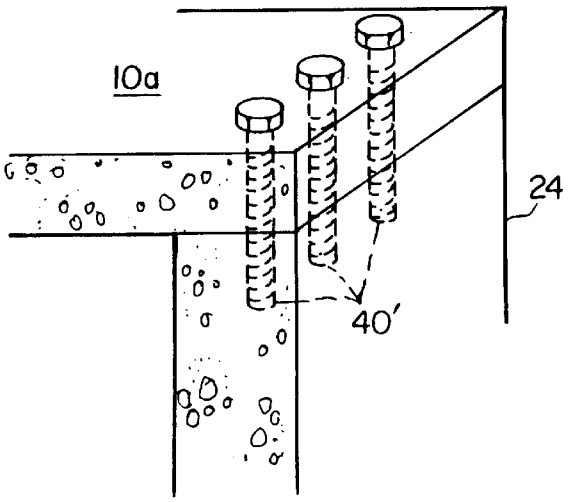
FIG. 4B is a three-dimensional view with parts broken away of an attachment device in an alternate embodiment of this invention.

Referring to FIG. 4A in a preferred embodiment of the present invention the slab 10*a* and peripheral wall 24 are integral and attached by steel reinforcing rods 40, such as rebar, disposed in the peripheral wall 24 and the slab 10*a*. In an alternate embodiment of the present invention, FIG. 4B, the slab 10*a* is attached to the peripheral wall 24 using bolts 40'. In another embodiment of the present invention, FIG. 4C, slab 10*a* is attached to the peripheral wall 24 with grout 40". In yet another embodiment of the present invention, FIG. 4D, slab 10*a* is a steel plate and is welded to a steel medium 40"' disposed along the top edge 32 of peripheral wall 29.

While the volume of the non-compressible liquid does not change as the system responds to an applied load, the volume of the non-compressible liquid need not remain constant through the, entire life of the structure. Due to settling of the underlying soil and losses due to leakage it may be necessary to provide additional fluid in order to maintain a full fluid level within the containment chamber to ensure proper support to the slab. In order to accomplish this, the net slab deflection can be monitored to determine when additional fluid must be added. Regardless of the loading pattern applied to the slab the average slab deflection must be zero. By taking readings at a sufficient number of points laid out in a given pattern on the slab surface the average deflection of the slab can be determined. If the average of all readings indicates a net downward deflection, additional non-compressible fluid is added to the containment chamber until the average readings return to zero. Normal use of a slab floor often rules out the use of slab surface monitoring devices.

Figure 5A:
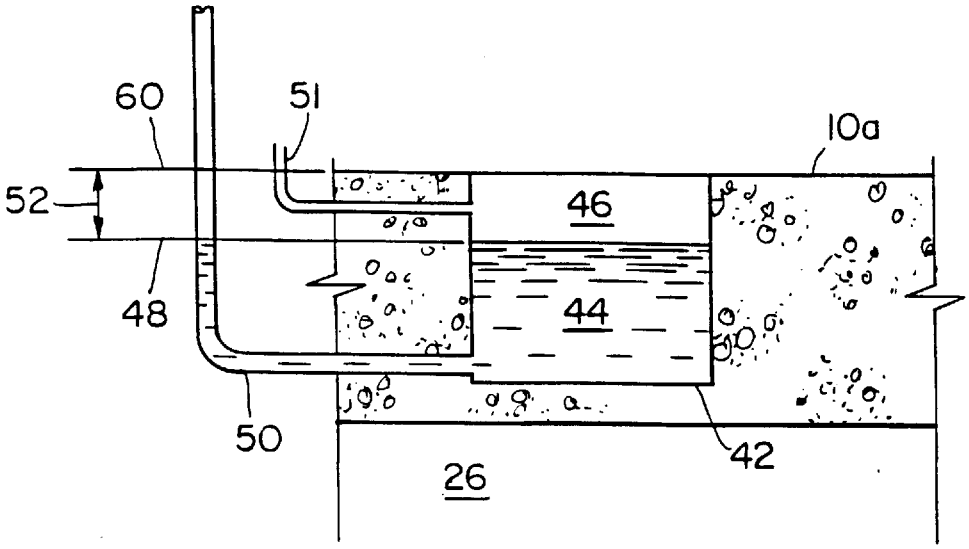
FIG. 5A is a schematic side sectional elevational view with parts broken away of one of a plurality of level sensors in a preferred embodiment of this invention.

In one embodiment there is a fluid level sensing system for monitoring the fluid level in the containment chamber. A plurality of modified "spirit levels" well known in the art can be used to monitor individual points on the slab. Within slab 10*a* is shown one of a plurality of reservoirs 42 which contain a liquid 44 such as water having a predetermined fluid level 48 relative to an original slab level 60 of slab 10*a* indicated by arrows 52, FIG. 5A. Within reservoir 42 there is also an air chamber 46. A level indicating tube 50 is embedded in slab 10*a* and is connected to reservoir 42. Thus, each point to be monitored is associated with its own level indicating tube 50. Each level indicating tube 50 may terminate at a common location (shown in FIG. 6) for viewing and averaging. This location should be at a point which does not undergo deflection due to an applied load, such as a point along the perimeter of the slab, or away from the slab. In order to prevent compression of the air chamber 46 and provide accurate leveling, the air chamber 46 may be vented to the atmosphere by a venting tube 51 embedded in slab 10*a*.

Figure 5B:
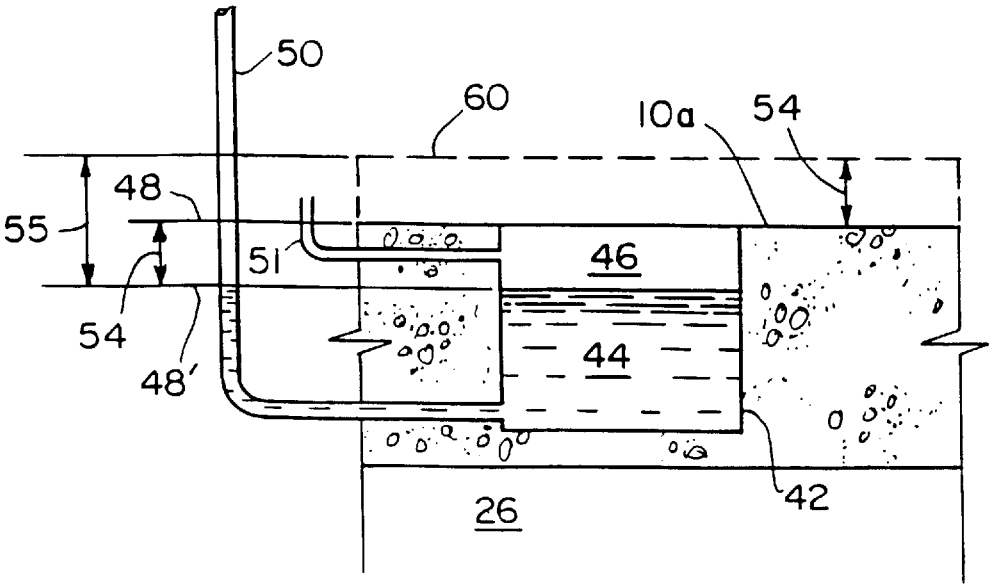
FIG. 5B is a view similar to FIG. 5A after the slab elevation has changed.

There is shown a monitoring point which has undergone a deflection of 1 inch indicated by arrows 54, FIG. 5B. The new liquid level 48' is now an additional inch below the original slab surface level 60 indicated by arrow 55. If the volume of the reservoir 42 is sufficiently large compared to the volume of tube 50 the flow of liquid 44 into tube 50 will have an inconsequential effect on the liquid level 48' of the reservoir. Therefore, a negative one inch deflection of slab 10*a* will translate to a 1 inch drop of the fluid level in level indicating tube 50. By observing and viewing the levels at a common location, the average deflection can be determined. If the average deflection falls below zero by a predetermined amount, additional fluid must be added to the containment chamber 26 to bring the average deflection back to zero.

Figure 6:
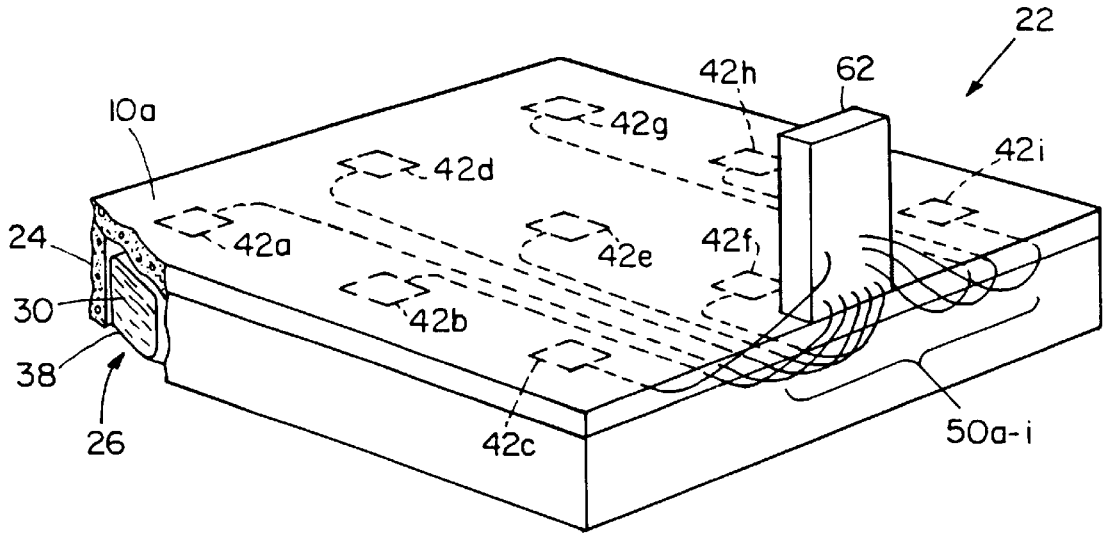
FIG. 6 is a three-dimensional view of a constant volume deformation support system according to the present invention where the ends of the individual level sensors are gathered at a common location for viewing and averaging.
Figure 7:
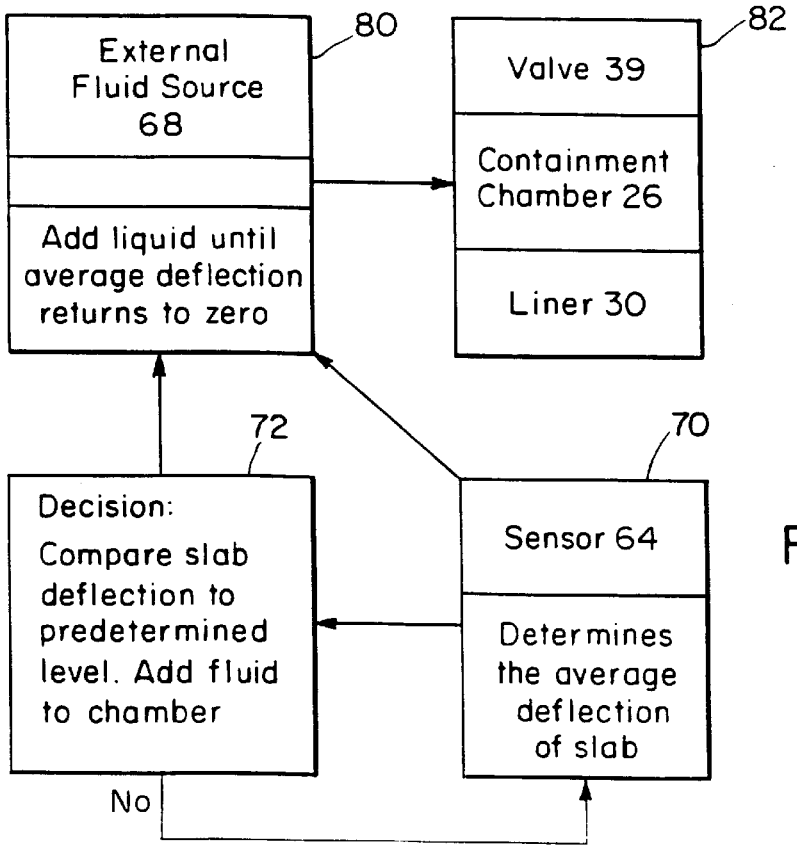
FIG. 7 is a block diagram of an automatic level sensing system of one embodiment of the present invention.

FIG. 6 is a three-dimensional view of a constant volume deformation support system 22 according to the present invention where a plurality of reservoirs 42*a–i* are embedded at predetermined points within slab 10*a*. A plurality of level indicating tubes 50*a–i* embedded in slab 10*a* and connected to reservoirs 42*a–i*, respectively, terminate at a common point 62 for viewing and averaging. In an alternate embodiment of the present invention averaging and viewing location 62 may include a device for adding additional non-compressible fluid 30 to the containment chamber 26. In yet another embodiment of the present invention viewing and averaging location 62 may include an automatic sensing system, FIG. 7. In block 70, sensor 64 determines the average slab deflection. Block 72 makes a decision whether additional fluid must be added to containment chamber 26 by comparing the average slab deflection to a predetermined value. If the decision is NO, sensor 64 of block 70 continues to monitor the average deflection and no fluid is added. If the decision is YES, external source of fluid 68, block 80, adds fluid through valve 39 to liner 38 located in containment chamber 26, block 82. Fluid continues to be added until sensor 64, block 70, determines an average slab deflection of zero. Block 80, recognizing that the slab deflection is zero, discontinues the addition of fluid to containment chamber 26, block 82.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A dynamic, self-compensating constant volume deformation support system comprising:

a sealed constant volume containment chamber including a base and a rigid peripheral wall;

a load-carrying deformable plate carried by and attached to said peripheral wall; and a non-compressible fluid filling said containment chamber for supporting said plate and in response to a load applied to one side of said plate and creating a negative deflection thereof, for creating an opposing offsetting pressure within said chamber uniformly distributed on the other side of said plate for creating a positive deflection of said plate and producing a net deflection an order of magnitude lower than normally induced by the applied load.

2. The dynamic self-compensating constant volume deformation support system of claim 1 in which said base and said peripheral wall are integral and are made of concrete.

3. The dynamic self-compensating constant volume deformation support system of claim 1 in which said base is soil.

4. The dynamic self-compensating constant volume deformation support system of claim 3 wherein said peripheral wall is made of concrete.

5. The dynamic self-compensating constant volume deformation support system of claim 4 in which said chamber includes a leakproof liner.

6. The dynamic self-compensating constant volume deformation support system of claim 5 in which said liner is made of PVC.

7. The dynamic self-compensating constant volume deformation support system of claim 5 in which said liner is made of HDPE.

8. The dynamic self-compensating constant volume deformation support system of claim 1 in which said non-compressible fluid is water.

9. The dynamic self-compensating constant volume deformation support system of claim 1 wherein said fluid includes a biocide.

10. The dynamic self-compensating constant volume deformation support system of claim 1 wherein said fluid includes antifreeze.

11. The dynamic self-compensating constant volume deformation support system of claim 1 in which said fluid includes a gelling agent.

12. The dynamic self-compensating constant volume deformation support system of claim 1 further including a device for adding non-compressible fluid to said chamber.

13. The dynamic self-compensating constant volume deformation support system of claim 1 further including a fluid level sensor system for monitoring the fluid level in said chamber.

14. The dynamic self-compensating constant volume deformation support system of claim 13 further including a fluid supply system responsive to said fluid level sensor system for adding fluid to said chamber.

15. The dynamic self-compensating constant volume deformation support system of claim 1 wherein said plate is a concrete slab.

16. The dynamic self-compensating constant volume deformation support system of claim 1 in which said plate is fixedly attached to said peripheral wall.

17. The dynamic self-compensating constant volume deformation support system of claim 16 in which said slab is attached to said wall with steel reinforcing rod disposed in said peripheral wall and said slab.

18. The dynamic self-compensating constant volume deformation support system of claim 16 in which said slab is attached to said wall with grout.

19. The dynamic self-compensating constant volume deformation support system of claim 16 in which said slab is attached to said wall using bolts.

20. The dynamic self-compensating constant volume deformation support system of claim 1 in which said plate is a steel plate.

21. The dynamic self-compensating constant volume deformation support system of claim 20 in which said peripheral wall includes a steel medium along its top edge.

22. The dynamic self-compensating constant volume deformation support system of claim 21 wherein said steel plate is welded to said peripheral wall.

* * * * *